US005467558A

United States Patent [19]

Kober et al.

[11] Patent Number: 5,467,558

[45] Date of Patent: Nov. 21, 1995

[54] RAIL CAR PLUG DOOR

[75] Inventors: Jeffrey F. Kober, Wauwatosa, Wis.; Victor A. Nelson, Springfield, Va.

[73] Assignee: Prime Composites, Inc.

[21] Appl. No.: 179,742

[22] Filed: Jan. 11, 1994

[51] Int. Cl.[6] ..... E05D 15/10

[52] U.S. Cl. ..... 49/220; 49/209; 49/501

[58] Field of Search ..... 49/501, 209, 210, 49/211, 216, 219, 220, 221, 246; 52/808

[56] References Cited

U.S. PATENT DOCUMENTS

| | | | |
|---|---|---|---|
| 3,415,015 | 12/1968 | Rolfe | 49/220 |
| 3,714,735 | 2/1973 | Owen | 49/220 |
| 3,885,349 | 5/1975 | Owen | 49/220 |
| 3,950,894 | 4/1976 | DiMaio | 49/501 |
| 4,170,845 | 10/1979 | Owen | 49/220 |
| 4,294,055 | 10/1981 | Andresen | 49/501 X |
| 4,344,256 | 8/1982 | King | 49/501 |
| 4,686,806 | 8/1987 | Bennett | 52/808 X |
| 5,016,395 | 5/1991 | Walker et al. | 49/501 |

*Primary Examiner*—Peter M. Cuomo
*Assistant Examiner*—Jerry Redman
*Attorney, Agent, or Firm*—Michael, Best & Friedrich

[57] ABSTRACT

A plug door including a door panel, an elongated crank rod supported by said door panel for pivotable movement relative thereto about a pivot axis, a door locking mechanism mounted on the door panel for pivoting said crank rod about the pivot axis, and the door panel having a channel substantially enclosing the crank rod.

12 Claims, 3 Drawing Sheets

RAIL CAR PLUG DOOR

BACKGROUND OF THE INVENTION

1. Technical Field

The invention relates generally to doors for closing openings in rail cars, and more particularly to plug doors.

2. Related Prior Art

Known plug doors generally include a steel door panel which is carried by a pair of pivotable crank rod assemblies. Such plug doors also provide a hand operable mechanism for pivoting the crank assemblies. Such plug doors are typically movable along door rails which support the crank assemblies and which extend laterally along the side of the rail car. The plug door can be moved along the door rails between an open position, wherein the door is located to one side of the opening, and an intermediate position, wherein the door overlies the opening. The mechanism for pivoting the crank rod assemblies is used for alternatively moving the door panel inwardly toward the rail car to sealingly close the opening or for moving the door panel outwardly of the opening.

SUMMARY OF THE INVENTION

One of the problems associated with known plug doors is that the crank rod assemblies are located on the outside of the door panel and are exposed to the operating environment of the rail car, which can be harsh. Such exposure increases the likelihood that the crank rod assemblies, and the door locking mechanism in general, will be damaged through misuse and by corrosion, which can make operation of the plug door assembly difficult and which generally increases the associated costs of maintaining and repairing such plug doors. For example, the crank rod assemblies can be damaged by pressing the plug door into the plug door opening by means other than by using the door locking mechanism.

Another problem associated with such known plug door assemblies is that the locking mechanism and associated connecting components are also generally exposed to the operating environment of the rail car and are permanently mounted on the door panel. The maintenance and repair or replacement of this mechanism and/or the associated connecting components must therefore be conducted rail side or necessitates the removal of the entire plug door from the rail car, both of which can be difficult and time consuming. Also, lifting equipment is needed to remove and install steel plug door panels.

Another problem associated with known plug doors is that the maintenance and repair of the crank rod assemblies and/or the door locking mechanism can be difficult. The crank rod assemblies can be difficult to remove from the plug door if the crank rods are bent, and the remaining components of the plug door locking mechanism can be difficult to remove from the plug door. In such a case, either the plug door must be removed from the rail car, which requires heavy lifting equipment, or the locking mechanism must be serviced rail side, which is often at least inconvenient and which renders the rail car unusable during the period of repair.

The invention provides a plug door including a door panel including an elongated recess, an elongated crank rod received in the recess and supported by the door panel for pivotable movement relative thereto about a pivot axis, door locking means mounted on the door panel for pivoting the crank rod about the pivot axis, and means for substantially enclosing the crank rod.

In one embodiment, the invention provides a plug door including a door panel having opposite edges and defining an elongated recess extending between the opposite edges, an elongated crank rod located in the recess support means located in the recess for supporting the crank round for pivotable movement about a pivot axis, a locking mechanism connected to the crank rod for pivoting the crank rod about the pivot axis, and a plate overlying the recess, the plate and the door panel substantially entirely enclosing the crank rod.

In one embodiment, the invention provides a plug door assembly for use on a rail car having a plug door opening, the assembly including a door panel having an outer face and an inner face being sealingly engageable with the rail car for closing the plug door opening, a pair of crank rods supported by the rail car and supporting the plug door, the crank rods being pivotable to move the door panel into and out of sealed engagement with the rail car; means including a locking cam assembly for pivoting the crank reds, and means for removably mounting the locking cam assembly on the door panel, the means for removably mounting the locking cam affording removal of the locking cam mechanism as a unit from the door panel.

In one embodiment, the invention provides plug door assembly for use on a rail car having a side wall defining plug door opening and providing a peripheral sealing surface, the plug door comprising a door panel configured to approximate the configuration of the plug door opening, the door panel including an edge member engageable with the peripheral sealing surface to sealingly close the plug door opening, the door panel having a thickness provided by a core having opposite faces, an inner skin made of composite materials bonded to one of the opposite faces of the core, an outer skin bonded to the other of the opposite faces of the core, the door panel defining a recess, an access panel removably fixed to the door panel in a position overlying and closing the recess, and at least one crank rod located in the recess, the crank rod having opposite ends extending beyond the edges of the door panel, the crank rod being substantially entirely housed within the door panel and the access panel.

One of the features of the invention is the provision of a plug door assembly having a plug door panel having therein a pair of elongated recesses and a pair of crank rod assemblies which are substantially entirely enclosed by the recesses and by a removable recess panel. The crank rods are protected from the operating environment of the rail car. Also, since the crank rod assemblies are located within the plug door, they are less susceptible to damage caused by the operation of equipment outside the rail car.

Another feature of the invention is the provision of a plug door assembly having enclosed crank rod assemblies and access panels that protect the crank rod assemblies and that are easily removable to facilitate inspection and maintenance of the crank rod assemblies.

Another feature of the invention is the provision of a plug door assembly having a door panel made of lightweight, high-strength composite materials that resist corrosion.

Another feature of the invention is the provision of a plug door having a door panel that can be filled with insulative material.

Another feature of the invention is the provision of a plug door including crank rod assemblies and a locking mechanism, each of which can be relatively easily removed from the door panel for maintenance, repair or replacement.

Other features and advantages of the invention will become apparent to those skilled in the art upon review of the following detailed description, claims and drawings.

DESCRIPTION OF THE DRAWINGS

FIG. 6 is an enlarged perspective view of a crank rod assembly.

Figure 1:
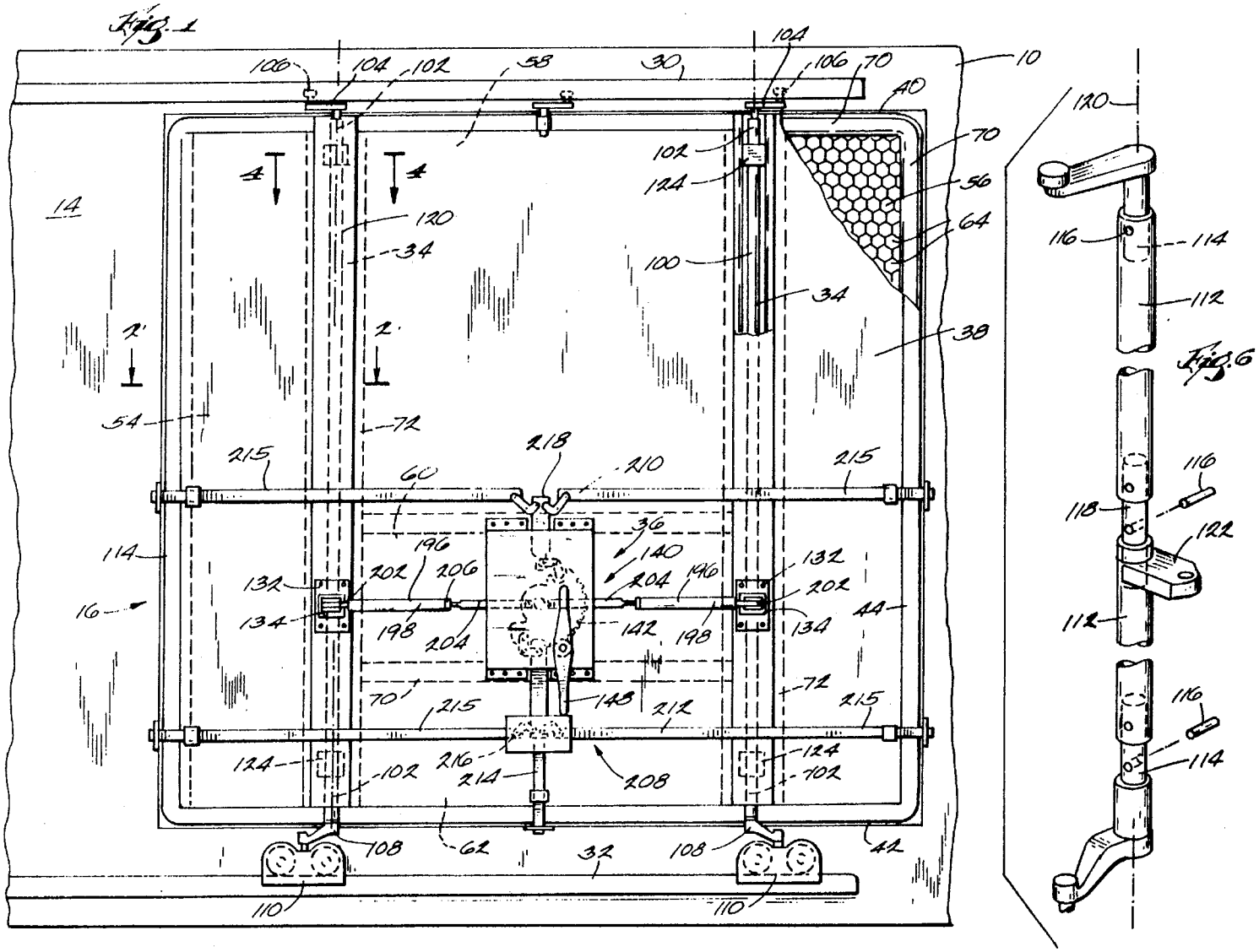
FIG. 1 is an elevational view, partially broken away for the purposes of illustration, of a portion of a rail car including a plug door assembly embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 2:
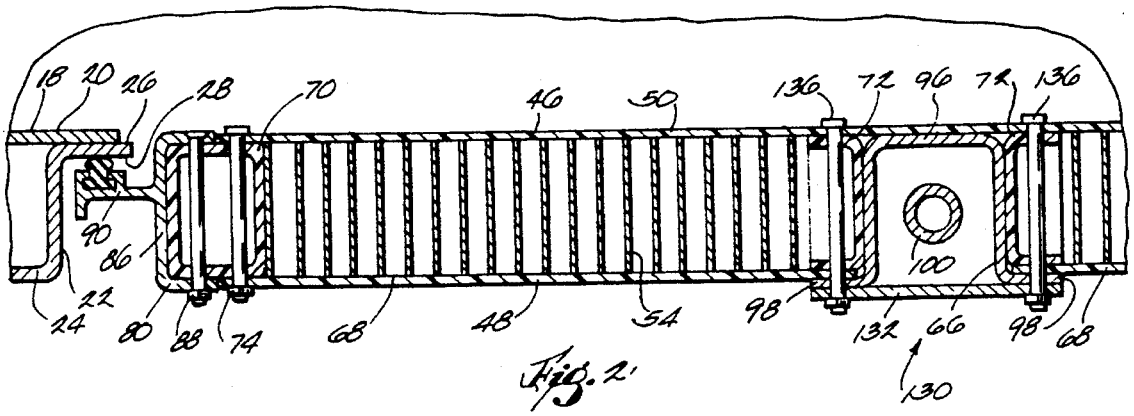
FIG. 2 is a cross-sectional view taken generally along line 2—2 in FIG. 1.

The drawings illustrate a rail car 10 having a generally rectangular plug door opening 12 located in a side wall 14 of the rail car 10 and a plug door assembly 16 for sealingly closing the plug door opening 12. As shown in FIG. 2, a door post 18 extends about the periphery of the door opening 12 and includes inner and outer door post members 20, 22. The outer door post member 22 has a first portion 24 that is substantially flush with the exterior (not shown in FIG. 2) of the side wall 14 of the rail car 10, and has a second portion 26 located adjacent the door opening 12. The second portion 26 is spaced from the first portion 24 inwardly of the rail car 10 and provides an outwardly facing sealing surface 28 that is engageable by the plug door assembly 16 in a manner discussed below.

The rail car 10 also includes (FIG. 1) upper and lower door rails 30, 32 that are respectively located above and below the door opening 12 and that extend laterally to one side of the door opening 12. A pair of crank rod assemblies 34 support the plug door assembly 16 on the door rails 30, 32 for movement between an open position (not shown) wherein the plug door assembly 16 is located outside of the rail car 10 and to one side of the plug door opening 12, and an intermediate position (not shown) wherein the plug door assembly 16 overlies, but is spaced outwardly of the door opening 12. A hand operable locking mechanism 36 is then used to rotate the crank rod assemblies 34 to move the plug door assembly 16 (as shown in FIG. 2) into sealed engagement with the plug door opening 12.

More particularly, the plug door assembly 16 includes (FIG. 1) a door panel 38 having a periphery that approximates the configuration and size of the door opening 12. The door panel 38 has horizontally extending upper and lower edges 40, 42, side edges 44 extending vertically between the upper and lower edges 40, 42, and (FIG. 2) opposed facing inward and outward faces 46, 48. The door panel 38 has a light weight and high-strength, skin-core-skin construction. In particular, the door panel 38 includes an inner skin 50 which provides substantially the entire inward face 46 of the door panel 38 and which is substantially uninterrupted in extent between the upper, lower and side edges 40, 42 and 44 of the door panel 38. The inner skin 50 is preferably a layer of composite material composed primarily of epoxy resin and a fibrous material, such as fiberglass or "E-glass." A suitable resin for use for the skin is manufactured by Shell Chemical Co., under the trademark "EPON" and a suitable fibrous material is manufactured by Owens-Corning under the trademark "Fiberglas".

The door panel 38 also includes a light-weight, high-strength honeycomb core 52. The core 52 is bonded to the inner skin 50 and is preferably made of a corrosion resistant metal, such as aluminum, or a formed thermoplastic honeycomb. While various suitable alternate constructions of the door panel 38 could be easily devised upon considering the illustrated door panel 38, in the illustrated embodiment of the plug door assembly 16, the core 52 is divided into five sections: a pair of end sections designated as a left end section 54 and a right end section 56 (shown in FIG. 1); and three vertically stacked sections extending between the end sections: a top section 58; a center section 60; and a bottom section 62.

Figure 3:
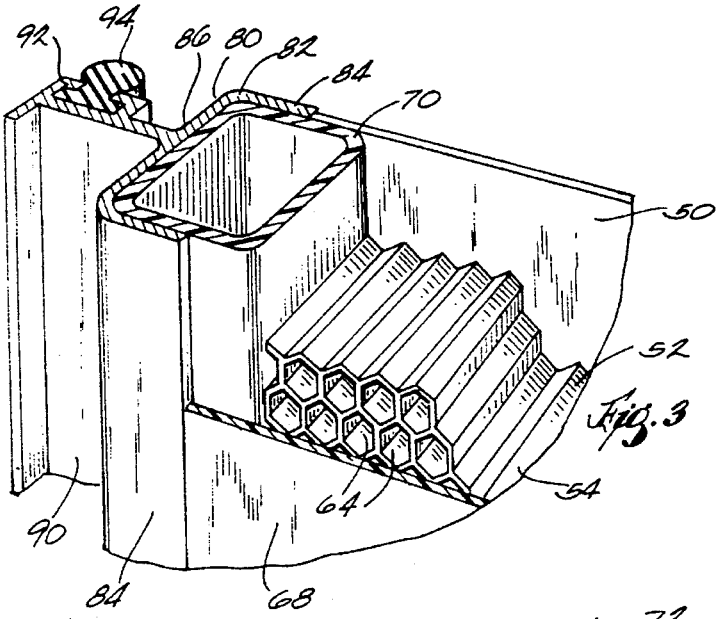
FIG. 3 is a perspective, cross-sectional view partially broken away of a portion of the plug door assembly shown in FIG. 1.

The core 52 (FIG. 3) has opposite inward and outward faces and defines a plurality of voids 64 extending between the opposite faces. The sections of the core 52 are arranged to provide (FIGS. 1, 2 and 5) a pair of elongated recesses 66 in which the respective crank shaft assemblies 34 are received. In particular, the left end section 54 is spaced from the ends of the top, center and bottom sections 58, 60, 62 of the core 52. Similarly, the right end section 56 is spaced from the ends of the top, center and bottom sections 58, 60, 62 of the core 52. The top, center and bottom sections 58, 60, 62 of the core 52 are vertically arranged in abutting relation, more specifically described below.

The inward face of each of the sections of the core 52 is bonded to the outwardly facing surface of the inner skin 50 with a suitable thermosetting resin. The resin bonds with the inner skin 50 to hold the inner skin 50 against the inward face of the sections of the core 52 and to hold the core sections in position.

The door panel 38 also includes an outer skin 68 which is bonded to the outward face of the sections of the core 52. The outer skin 68 can be bonded to the sections of the core 52 by using a thermosetting epoxy resin, or can be applied to the sections of the core 52 while the resin in the skin 68 remains adhesive, so that the outer skin 68 bonds to the sections of the core 52 as the resin in the outer skin 68 cures.

While the illustrated embodiment of the door panel 38 shows the voids of the core 52 as being hollow, the voids may also be filled with thermally insulative material, such as a foamed insulation that is blown into the core 52 against the inner skin 50 prior to closing the door panel 38 with the outer skin 68. When the door panel 38 is filled with such an insulative material, the plug door is well suited for use with a refrigerated rail car 10.

The door panel 38 also includes two pluralities of close-out members 70, 72 extending around the periphery of each of the sections of the core 52. The close-out members 70, 72 have alternative constructions depending upon the position of the close-out member within the door panel 38: either a tubular construction or a u-shaped channel construction. In general, the close-out members 70 having a tubular construction are positioned in abutting relation to the edges of core sections which define the periphery of the door panel 38. For example, the close-out members 70 closing the laterally outer edges of the left and right end sections 54, 56 of the core 52, and the upper and lower edges 40, 42 of the door panel 38 each have a tubular construction. Also, the close-out members 70 lying between the edges of the top and center sections 58, 60 of the core 52 and between the center and bottom sections 60, 62 of the core 52 have a tubular construction.

The edges of core sections which define the door panel recesses 66 abut elongated close-out members 72 that are in the form of a channel having a u-shaped cross-section. The channel close-out members 70 have side walls 84 that abut an edge of the associated section of the core 52 and have a bight portion 86 spaced from the edge of the core 52. The close-out members 70, 72, regardless of their configuration, should be made of a suitable material, such as extruded aluminum, to provide a light weight, stable and relatively strong structure.

The close-out members are fixed to the sections of the core 52 and to the inner and outer skins 50, 68 through at least one of two available means. First, the inner and outer skins 50, 68 extend past the sections of the core 52 and slightly overlap the close-out members 70, 72. Second, the door panel 38 also includes a plurality of fasteners (one shown An FIG. 2), such as belts 74, that are located around the periphery of the sections of the core 52. The fasteners extend through the inner and outer skins 50, 68 and through a close-out member 70 or 72 to assure that the inner and outer skins 50, 68 remain secured to the core 52 and to the close-out members 70, 72. It should be recognized that, depending upon the types of materials used, the door panel 38 can be successfully constructed using only adhesive bending of the skins 50, 68, or only the belts 74 or a combination thereof.

The door panel 38 also includes (FIGS. 1–3) an edge member 80 which extends about the periphery of the door panel 38 and which overlies portions of the tubular close-out members 70 located on peripheral edges of the door panel 38. The edge member 80 includes (FIGS. 2 and 3) a channel 82 having a u-shaped cross-section provided by spaced-apart side walls 84 that receive therebetween a portion of the tubular close-out members 70 otherwise left exposed by the inner and outer skins 50, 68 of the door panel 38. The side walls 84 abutt the edges of the inner and outer skins 50, 68. The side walls 84 are joined by a bight portion 86 that abutts the close-out member 70. The edge member 80 is fastened to the door panel 38 by a plurality of fasteners 88 (one shown in FIG. 2), that extend through the side walls 84 of the edge member 80 and through the associated the close-out member 70.

The edge member 80 also includes a flange 90 that extends from the bight portion 86 laterally outwardly, and that provides a seal retaining channel 92. The seal retaining channel 92 opens inwardly of the rail car 10 and, when the plug door assembly 16 is registered with the door opening 12 as shown in FIG. 2, the seal retaining channel 92 aligns with the sealing surface 28 on the outer post member 22. A rubber seal 94 is held by the seal retaining channel 92 and sealingly engages the sealing surface 28 of the post member 22 when the plug door assembly 16 is moved inwardly of the door opening 12.

The space between the left end section 54 and the central sections of the core 52, and the space between the central sections of the core 52 and the right end section 56 define, in part, the recesses or channels 66 for receiving a crank red assembly 34. The recesses 66 are generally parallel and each extend between the upper and lower edges 40, 42 of the door panel 38.

Figure 4:
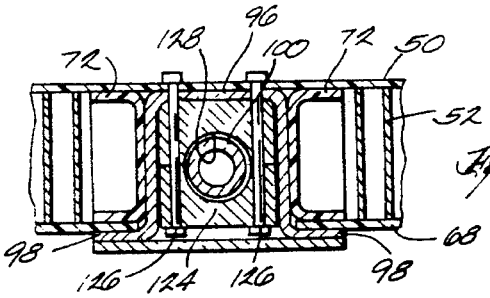
FIG. 4 is a cross-sectional view taken along line 4—4 in FIG. 1.

In the embodiment of the plug door assembly 16 shown in FIGS. 2 and 4, the recesses 66 are further defined by an elongated channel or "hat-piece" 96 that is received between the bight portions of the channel-like close-out members 72 and that abuts the inner skin 50. The hat piece 96 also includes a pair of laterally splayed flanges 98 that overlie the outward side wall of the close-out members 72. The hat piece 96 is fixed to the door panel 38 in a manner discussed below.

Figure 5:
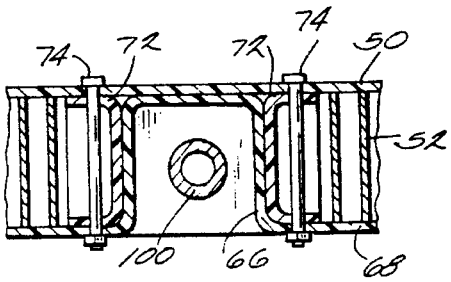
FIG. 5 is a cross-sectional view similar to the view of FIG. 2 and illustrating an alternative construction of a plug door assembly embodying the invention.

In an alternative embodiment of the plug door assembly 16 shown in FIG. 5, the hat piece 96 is eliminated. Also, the outer skin 68 does not terminate at the close-out member 72 adjacent the door panel recess 66, but extends continuously into the recess 66 and into contact with the outward face of the inner skin 50. Specifically, the continuous outer skin 68 extends from the outward face of one of the core sections, inwardly of the recess 66 into contact with the inner skin 50, thereby enclosing the close-out member 72. The outer skin 68 continues outwardly of the recess 66 over the other close-out member 72 to the outer face of the other section of the core 52.

The plug door assembly also includes the aforementioned pair of crank rod assemblies 34. Each crank rod assembly 34 includes (FIGS. 2 and 4–6) an elongated, generally tubular crank pipe or crank rod 100 located in a respective one of the recesses 66. Each crank rod 100 is generally elongated and has (FIG. 1) opposite ends 102 extending out of the ends of the recess 66 in which is received. The upper end of each crank rod 100 supports a top crank 104 that includes a roller 106 engaged with the upper door rail 30. The lower end of each crank rod 100 supports a bottom crank 108 that is pivotably engaged with a roller assembly 110 on the lower door rail 32.

The crank rods 100 may be made of steel or another suitable material, but are preferably an assembly of hardware and two tubular crank rod sections 112 made of a filament wound composite material. More particularly, and as shown in FIG. 6, the top and bottom cranks 104, 108 each have a shank 114 that is received within an end of a respective crank rod section 112. The top and bottom cranks 104, 108 are rotationally fixed to the respective crank rod sections 110 by a pin 116 extending therethrough or by a similar means. The crank rod sections 112 are connected by a steel adapter 118 having opposite shanks 120 received by and rotationally fixed to the respective crank rod sections 112. When so assembled, each crank rod 100 defines a pivot axis 120 extending longitudinally within the crank rod sections 112. For reasons discussed below, the adapter 118 also has a radially extending tab 122.

Each of the crank rod assemblies 34 also include two pairs of fulcrums or bearing blocks 124 that are located within each of the door panel recesses 66. Each bearing block 124 is located adjacent either the upper or lower edge 40, 42 of the door panel 38. The bearing blocks 124 are fixed to the door panel 38 by fasteners 126 extending through the inner skin 50 and have extending therethrough a bore 128 which houses a portion of a crank rod 100. In the illustrated embodiment, each bearing block 124 is split into a pair of symmetrical halves to facilitate assembly of the plug door assembly 16. The bearing blocks 124 can be located, but not fixed, within a recess 66 and then separated to receive a crank rod 100. Once the crank rod 100 is positioned within a recess, the bearing block 124 can be reassembled and fixed together in place with the pair of fasteners 126 extending therethrough. The bearing blocks 124 support the crank rods 100 for pivotal movement relative to the door panel 38 and, in the embodiment of the plug door assembly 16 including a hat piece 96, fix the hat piece 96 to the door panel 38.

The top and bottom cranks 104, 108 are oriented so that the crank roller 106 and the door roller assembly 110 are generally vertically aligned. When pivoted about the respective pivot axes 120, the crank rods 100 bear against the bearing blocks 124 and move the plug door assembly 16 inwardly of the door 12 opening into sealed engagement with the door post 18 or, alternatively, move the plug door assembly 16 outwardly of the door opening 12 to afford movement of the plug door assembly 16 to the side of the door opening 12.

The plug door assembly 16 also includes means 130 cooperating with the door panel 38 for substantially enclosing each of the crank rods 100. While various suitable constructions for such means 130 could be used, in the illustrated embodiment, the plug door assembly 16 includes a pair of access plates or panels 132 overlying and closing a respective recess 66. The access panels 132 are preferably made of a composite material, such as a panel of material used for the inner and outer skins 50, 68, and extend along substantially the entire length of the recesses 66 to enclose the crank rods 100 within the door panel 38. Each access panel 132 has extending therethrough a slot 134 that surrounds the tab 122 extending from each crank rod 100 outwardly of the recess 66. The slot 134 is elongated to afford pivotal movement of the tab 122, and of the associated crank rod 100.

The access panels 132 are removably secured to the exterior of the door panel 38 by a plurality of fasteners, such as the bolts 136 shown in FIGS. 2 and 5, and afford ready means for gaining access to the door panel recesses 66 for inspection, maintenance and repair of the crank rods 100. When the access panels 132 are secured to the door panel 38, with the exception of the top and bottom cranks 104, 108, the crank rods 100 are substantially entirely enclosed by the access panels 132 and the door panel 38 within the thickness of the door panel 38.

The plug door assembly 16 also includes locking means 140 for pivoting the crank rods 100 about their respective pivot axes 120 to move the plug door assembly 16 inwardly of the rail car 10 to sealingly close the plug door opening 12 and alternatively to move the plug door assembly 16 outwardly of the plug door opening 12. While various suitable locking means 140 can be used for pivoting the crank rods 100, in the illustrated embodiment, such means 140 includes a seal cam assembly 142 that is centrally located on the exterior face of the door panel 38. The seal cam assembly 142 includes a locking gear 144, a pinion 146 engaged with the locking gear 144, and an operator handle 148 supported by the pinion 146. The locking gear 144 and pinion 146 are mounted on the door panel 38 in a manner discussed below. Rotation of the operator handle 148 rotates the pinion 146 and the locking gear 144. The locking means 140 also includes a pair of blocks 150, 152 that are engageable with the locking gear 144 to prevent rotation thereof, and define a range of pivotable movement of the locking gear 144. In particular, the locking means 140 includes (FIG. 7) a first pivot block 150 that engages the locking gear 144 when the locking gear 144 is rotated (counterclockwise in FIG. 7) to a first extreme position, and a second pivot block 152 that engages the locking gear 144 when the locking gear 144 is rotated (clockwise in FIG. 7) to a second extreme position (not shown).

Figure 9:
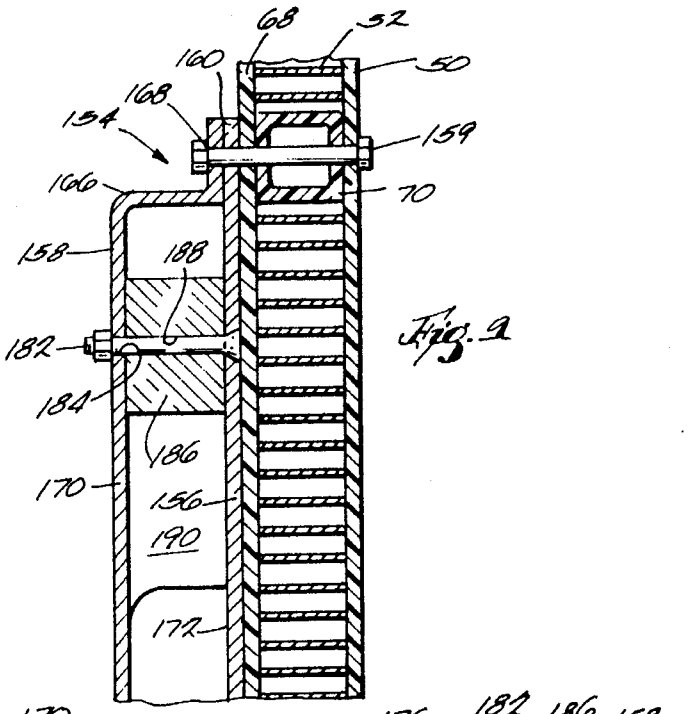
FIG. 9 is a cross-sectional view taken along line 9—9 in FIG. 7 showing the mounting plate cover.

The plug door assembly 16 also includes mounting means 154 for removably mounting the seal cam assembly 142 on the door panel 38. While various suitable constructions for the such mounting means 154 can be employed, in the illustrated plug door assembly 16, the mounting means 154 includes (FIGS. 7–9) a mounting plate 156 and a mounting plate cover 158. The mounting plate 156 and the mounting plate cover 158 are fixed together by removable fasteners, such as bolts 159, and when assembled, are fixed to the door panel 38. As discussed more particularly below, the mounting means 154 affords removal of the seal cam assembly 142 from the door panel 38 as a single unit.

More particularly, the mounting plate 156 is located on the exterior face of the door panel 38 and is situated so as to overlie the center section 60 of the core 52. The mounting plate 156 has upper and lower edges 160, 162 that align with the tubular close-out members 70 respectively located between the center and top sections 60, 62 of the core 52 and between the center and bottom sections of the core 52. The upper and lower edges 160, 162 of the mounting plate 156 have therethrough a row of holes 164 for receiving bolts that extend through the door panel 38 and through the close-out members 70. The close-out members 70 along the edges of the mounting plate 156 are necessary to provide underlying structure having the strength and rigidity to support the seal cam assembly 142.

Figure 8:
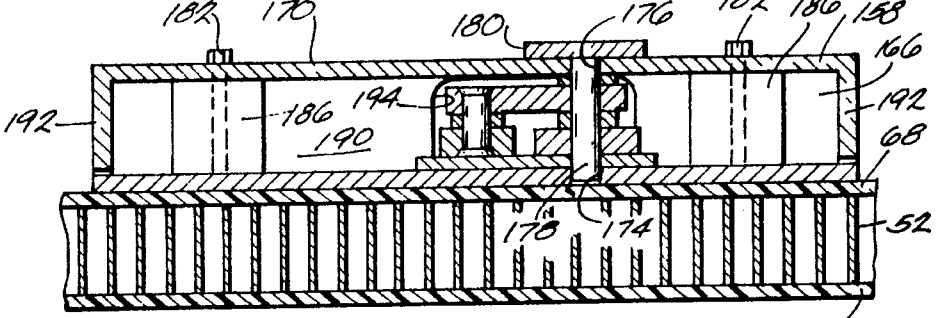
FIG. 8 is a cross-sectional view taken along line 8—8 in FIG. 7 showing the mounting plate cover.

The mounting plate cover 158 has opposite end portions 166 (one shown in FIGS. 8 and 9) that overlie the edges 160, 162 of the mounting plate 156. The end portions 166 have therethrough a plurality of fastener holes 168 that register with the holes 164 in the mounting plate 156 and that receive the fasteners 159 to secure the mounting plate 156 and the mounting plate cover 158 to the door panel 38. The mounting plate cover 158 also has a central portion 170 that is spaced outwardly from the central portion 172 of the mounting plate 156. The central portions 172, 170 of the mounting plate 156 and the mounting plate cover 158 have therein various bores for supporting the rotatable components of the seal cam assembly 142. For example, as shown in FIG. 8, the mounting plate 156 has therein an aperture 174 that aligns with an aperture 176 in the mounting plate cover 158. A pin 178, the purpose of which is discussed below, extends into and is retained by the respective apertures 174, 176 in the mounting plate 156 and the mounting plate cover 158. The pin 178 is further retained in position by a cover plate 180 that overlies the aperture 176 through the mounting plate cover 158 and that Is bonded to the mounting plate cover 158.

The mounting plate 156 and the mounting plate cover 158 are fixed together by fasteners 182 independent of the fasteners 159 securing the mounting plate 156 to the door panel 38. In particular, the mounting plate 156 and the mounting plate cover 158 have therethrough a plurality of aligned apertures 184 (one shown in the mounting plate 156 and one shown in the mounting plate cover 158 in FIG. 9). The apertures 184 in the mounting plate 156 have a counterbore in the face of the mounting plate 156 against the outer skin 68 of the door panel 38 to provide space for the head of a fastener 182. A plurality of spacer blocks 186, each having a bore 188 extending therethrough and having a thickness approximating the space between the central portions 172, 170 of the mounting plate 156 and the mounting plate cover 158, are aligned with the apertures 184. A plurality of fasteners 182 extend through the aligned apertures 184 in the mounting plate 156 and the mounting plate cover 158, and through the bores 188 in the spacer blocks 186 to secure the mounting plate 156 and the mounting plate cover 158 together.

The mounting plate 156, the mounting plate cover 158, and the seal cam assembly 142 can be removed as a unit from the door panel 38 by removing the fasteners 159 extending through the mounting plate 156 and mounting plate cover 158, and through the door panel 38. Removal of the fasteners 159 releases the mounting plate 156 and the mounting plate cover 158, but does not result in the mounting plate 156 and the mounting plate cover 158 falling apart because the connection therebetween is maintained by the fasteners 184 extending through the spacer blocks 186.

The spaced apart central portions 172, 170 of the mounting plate 156 and the mounting plate cover 158 thus define therebetween an interior space 190 that substantially houses the seal cam assembly 142. In this regard, the interior space 190 is further defined by side walls or an apron 192 that extends from the central portion 170 of the mounting plate cover 158 (only one side wall shown in FIG. 9) toward the mounting plate 156. Also, the mounting plate cover 158 has therein clearance recesses 194 located in the middle of the upper and lower portions of the mounting plate cover 158 (only the recess in the upper portion shown in FIG. 8) that provides clearance for components that, for reasons discussed below, are actuatable by the locking gear 144.

Figure 7:
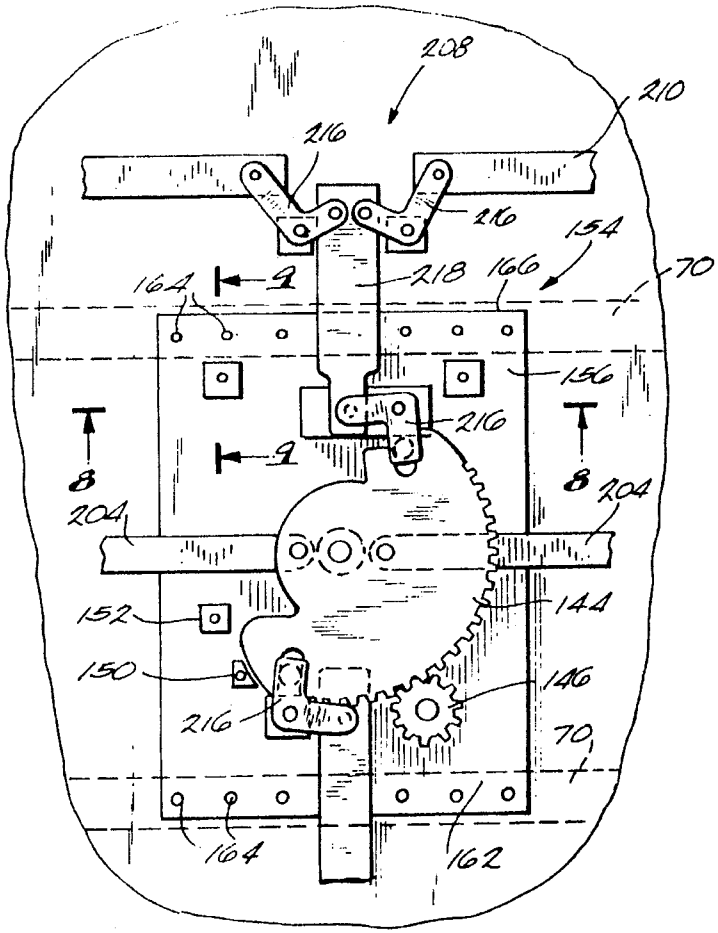
FIG. 7 is an enlarged view of a portion of the plug door with the mounting plate cover removed.

The plug door assembly 16 also includes a pair of connecting rod assemblies 196 that extend between the locking gear 144 and a respective crank rod 100. Each connecting rod assembly 196 includes a connecting rod 198 having opposite ends 200. One opposite end 200 of each connecting rod 198 is in the form of a clevis 202 that is pinned to the tab 122 on the associated crank rod 100. The opposite end 200 of the connecting rod 198 is an open ended, interiorly threaded tube. Each connecting rod assembly 196 also includes a "rod end" 204 that is connected to the locking gear 144 and that is connectable to one of the connecting rods 198. As shown in FIG. 7, each rod end 204 is connected to the locking gear 144 through a pinned connection. The opposite end of each red end 204 is threaded into the tubular end of a connecting rod 198. The length of each connecting rod assembly 196 is adjustable through the threaded connection of the connecting rod 198 and the rod end 204, and is fixed by means of a locking nut 206 on each rod end 204.

The locking gear 144 and connecting rods 198 are thus operably connected by means of the connecting rod assemblies 196 so that rotation of the operator handle 148 in one direction rotates the locking gear 144 and moves the connecting rod assemblies 196 laterally away from the locking gear 144, and rotation of the operator handle 148 in the other direction moves the connecting rod assemblies 196 toward the locking gear 144. In particular, and as shown in FIG. 1, when the locking gear 144 is in an the first extreme position, i.e., wherein the locking gear 144 in fully rotated (counterclockwise in FIG. 1), the connecting rod assemblies 196 are moved laterally outwardly as far as possible, and the crank rods 100 are fully rotated. When the connecting rods 198 are so driven laterally outwardly by the locking gear 144, the top and bottom cranks bear respectively against the upper and lower rails and the crank rods 100 bear against the bearing blocks 124 to move the door panel 38 inwardly of the plug door opening 12 and into sealed engagement with the door post. Rotation of the locking gear 144 from the first extreme position toward the second extreme position (in the clockwise direction in FIG. 1) draws the connecting rods 198 toward the locking gear 144, thereby rotating each of the crank rods 100 about their respective pivot axis 120. Such rotation of the crank rods 100 causes the top and bottom cranks 104, 108 to bear respectively against the upper and lower door rails 30, 32 and causes the crank rods 100 to bear against the bearing blocks 124. The plug door assembly 16 is thus moved outwardly of the plug door opening 12 to a position overlying the plug door opening 12 and spaced from the opening 12.

The locking means 140 also includes an auxiliary locking system 208. The auxiliary locking system 208 includes upper and lower horizontal lock bar assemblies 210, 212 and a vertical bar lock assembly 214. The upper and lower horizontal lock bar assemblies 210, 212 and the vertical lock bar assembly 214 are actuatable through rotation of the operator handle 148 and the locking gear 144 to lock the plug door assembly 16 in place when it is moved into sealed engagement with the door post 18. In particular, the upper and lower horizontal lock bar assemblies 210, 212, and the vertical lock bar assembly 214 each include respective lock bars 215 having ends that are engagable with the side wall 14 of the rail car 10 adjacent the plug door opening 12. The upper and lower horizontal lock bar assemblies 210, 212 each also include actuator cams 216 that are pivotably mounted on the door panel 38. The actuator cams 216 are pinned to the lower vertical lock bar 212, and the actuator came 216 of the upper horizontal lock bar assembly 210 are pinned by, for example, pin 178 to an upper vertical lock bar 218. The upper and lower vertical lock bars 214, 218 extend through the clearance recesses 194 in the mounting plate cover 158 and are engaged with the locking gear 144 when (FIG. 7) the locking gear 144 is rotated to the first extreme position. When the upper and lower lock bars 214, 218 are so engaged, each is driven away from the locking gear 144, thereby driving the upper and lower horizontal lock bars 215 laterally outwardly and into engagement with the side wall 14 of the rail car 10. When the plug door opening 12 is not sealed closed, i.e., when the locking gear 144 is rotated away from the first extreme position, the lock bars are initially retracted as the crank rods 100 begin to rotate, and are subsequently fully retracted within the periphery of the door panel 38 so as not to interfere with movement of the plug door assembly 16 into or out of the plug door opening 12.

Various features of the invention are set forth in the following claims.

We claim:

1. A plug door comprising a door panel including a first section of core having a first section planar face and a first section edge, a second section of core having a second section planar face and a second section edge spaced from the first section edge, said door panel also including a first skin bonded to said first and second section planar faces and extending between said first and second section edges, said skin, said first section edge, and said second section edge defining therebetween an elongated door panel recess opening away from said first and second section planar surfaces, said door panel also including an elongated support member received by said door panel recess, said support member having a U-shaped cross-section when viewed in a plane perpendicular to said length of said support member and opening away from said first and second planar surfaces, an elongated crank rod received in and supported by said door panel for pivotable movement relative thereto about a pivot axis, door locking means mounted on said door panel for pivoting said crank rod about said pivot axis, and a cover secured to said door panel and extending between said first and second section edges to close said door panel recess.

2. An assembly as set forth in claim 1 wherein said door panel has a thickness, and wherein said crank rod is enclosed within said thickness.

3. An assembly as set forth in claim 2 wherein said thickness is provided by said first and second sections of core and includes a second skin bonded to each of said sections of core.

4. An assembly as set forth in claim 3 wherein said cover for closing said door panel recess is secured to said door panel in a closed position wherein said access cover overlies a portion of said second skin and is removable from said closed position for affording access to said crank rod.

5. An assembly as set forth in claim 3 wherein said first and second sections core are filled with insulating material.

6. An assembly as set forth in claim 5 wherein said first and second sections of core have a honeycomb construction including a plurality of voids, and wherein said insulating material fills said voids.

7. A plug door assembly for use on a rail car having a plug door opening, said assembly comprising a door panel having an outer face and an inner face and being sealingly engageable with said rail car for closing the plug door opening, a pair of crank rods supported by the rail car and supporting said plug door, said crank rods being pivotable to move said door panel into and out of sealed engagement with said rail car, a seal cam assembly for pivoting said crank rods, said seal cam assembly including a locking gear, a pinion engaged with said locking gear, and an operator handle supported by said pinion, and means for removably mounting said seal cam assembly on said outer face of said door panel, said means for removably mounting said seal cam assembly including a mounting plate, a mounting plate cover fixed to said mounting plate, said mounting plate and said mounting plate cover supporting said seal cam assembly, and a plurality of fasteners extending through one of said mounting plate and said mounting plate cover and engaging said door panel.

8. A plug door assembly as set forth in claim 7 wherein said door panel has a skin-core-skin construction.

9. A plug door assembly as set forth in claim 7 wherein said mounting plate and said mounting plate cover define therebetween an interior space housing said seal cam assembly.

10. A plug door assembly for use on a rail car having a side wall defining a plug door opening and providing a peripheral sealing surface, said plug door comprising a door panel including an edge member engageable with the peripheral sealing surface, said door panel having a thickness provided by a core having opposite faces, an inner skin made of composite materials bonded to one of said opposite faces of said core, an outer skin bonded to the other of said opposite faces of said core, said door panel defining a recess, an access panel fixed to said door panel in a position overlying said recess and having extending therethrough an elongated slot, and at least one crank rod located in said recess and having a portion extending through said elongated slot, a bearing located in said recess and supporting said crank rod for pivotal movement about a pivot axis, and means for pivoting said crank rod, said means including a seal cam assembly mounted on said outer skin of said door panel and a connecting rod operably connected to said seal cam assembly and said portion of said crank rod.

11. An assembly as set forth in claim 10 wherein said portion of said crank rod extending through said slot is a tab fixed to and extending radially from said crank rod, and wherein said slot in said access panel receives said tab and affords pivotal movement of said crank rod and said tab along said slot.

12. A plug door comprising a door panel including an elongated recess, an elongated crank rod received in said recess and supported by said door panel for pivotable movement relative thereto about a pivot axis, door locking means mounted on said door panel for pivoting said crank rod about said pivot axis, and means for substantially enclosing said crank rod, wherein said door panel has a thickness, and wherein said crank rod is enclosed within said thickness, wherein said thickness is provided by a core having opposite faces and a skin bonded to each of said opposite faces of said core, and wherein said means for substantially enclosing said crank rod includes an access plate that can be mounted on said door panel in a first position wherein said access plate overlies said recess and that can be removed from said door panel to afford access to said crank rod.

* * * * *